US006279284B1

(12) United States Patent
Moras

(10) Patent No.: US 6,279,284 B1
(45) Date of Patent: Aug. 28, 2001

(54) COMPOSITE VAPOR BARRIER PANEL

(75) Inventor: Guy Moras, Repentigny (CA)

(73) Assignee: Emco Limited (CA)

( * ) Notice: Subject to any disclaimer, the term of this patent is extended or adjusted under 35 U.S.C. 154(b) by 0 days.

(21) Appl. No.: 09/227,535

(22) Filed: Jan. 11, 1999

(30) Foreign Application Priority Data

Jan. 12, 1998 (CA) ..... 2226595

(51) Int. Cl.[7] ..... E04C 2/00

(52) U.S. Cl. ..... 52/408; 52/105; 52/481.1; 52/483.1

(58) Field of Search ..... 52/105, 408, 481.1, 52/508, 483.1

(56) References Cited

U.S. PATENT DOCUMENTS

| | | | | |
|---|---|---|---|---|
| 965,595 | * | 7/1910 | Nicholson | 52/481.1 |
| 1,914,345 | * | 6/1933 | Roos | 52/408 |
| 3,159,882 | * | 12/1964 | Slayter | 52/411 |
| 3,165,791 | * | 1/1965 | Valsvik | 52/405.4 |
| 3,826,055 | * | 7/1974 | Bobzin et al. | 52/511 X |
| 4,109,043 | * | 8/1978 | DeLapp | 428/206 |
| 4,564,554 | * | 1/1986 | Mikuski | 428/292.4 |
| 4,924,644 | * | 5/1990 | Lewis | 52/105 |
| 5,134,831 | * | 8/1992 | Avellanet | 52/408 X |
| 5,214,894 | * | 6/1993 | Glesser-Lott | 52/408 |
| 5,732,520 | * | 3/1998 | Maietta | 52/483.1 |
| 5,743,058 | * | 4/1998 | Boomsma | 52/483.1 X |
| 5,768,841 | * | 6/1998 | Swartz et al. | 52/408 X |
| 5,925,211 | * | 7/1999 | Rakauskas | 156/306.9 |
| 5,953,883 | * | 9/1999 | Ojala | 52/481.1 X |

FOREIGN PATENT DOCUMENTS

| | | |
|---|---|---|
| 1109382 | 9/1981 | (CA) . |
| 2006652 | 12/1989 | (CA) . |
| 2070489 | 6/1992 | (CA) . |
| 2076515 | 2/1994 | (CA) . |
| 2156145 | 8/1995 | (CA) . |
| 1 400 922 | 7/1975 | (GB) . |

* cited by examiner

*Primary Examiner*—Beth A. Stephan
*Assistant Examiner*—Brian E. Glessner
(74) *Attorney, Agent, or Firm*—Nixon & Vanderhye P.C.

(57) ABSTRACT

A fibreboard, insulating, wall panel includes an integral air and vapor barrier of metal foil or metallized plastic film adhered to one surface of the panel. Panels are attached to a stud wall frame. Abutting panel joints are taped to provide a continuance vapor barrier. Increased thermal and acoustic insulation as well as structural integrity of the barrier is provided by the panel.

15 Claims, 2 Drawing Sheets

COMPOSITE VAPOR BARRIER PANEL

Figure 1:
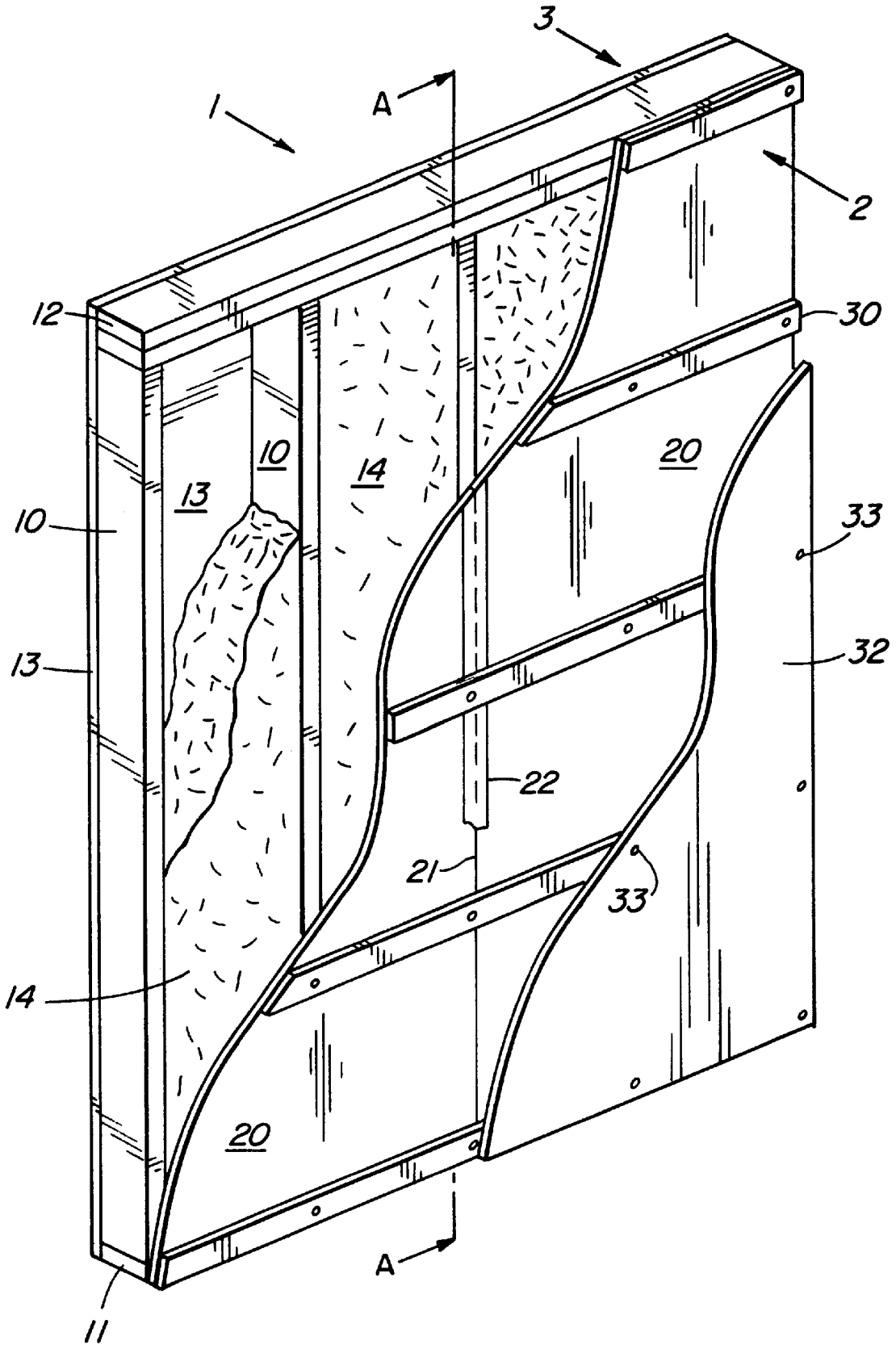

The present invention relates to a building panel for use in stud wall framing typically used in North American residential construction. The panel provides additional thermal and acoustic insulation to the building structure, as well as air and vapour barriers required by building codes. In particular, the building panel of the present invention comprises a semi-rigid structural insulating component and a layer of air and moisture impermeable material integrally adhered to one surface of the insulating component. Preferably, the insulating component comprises a low or medium density fibreboard material and the air and vapour barrier is a metal foil or metallized plastic film which is adhered to one face of the insulating component during the manufacturing process.

Prior Art

It is known, in building constructions such as residential stud wall framing, to provide an air barrier in order to substantially reduce or prevent air infiltration into or out of the building envelope. As well, use of a vapour barrier is known to prevent moisture present in the building interior from passing into insulation which has been applied to the structure. In cold climates, the vapour barrier prevents ingress and subsequent freezing of any moisture in the insulation installed in the stud wall cavities. The use of air barriers and vapour barriers is mandated by many building codes. For example, under the National Building Code of Canada, Section 5.4.1.2 requires an air barrier, and Section 5.5.1.2 requires a vapour barrier on the warm side of an insulated stud wall frame.

It is known that the air barrier may be comprised of sheathing on the exterior of a stud wall structure, or may be combined with the vapour barrier on the interior of the stud wall structure. Typically, a combined air and vapour barrier has been formed from polyethylene or polypropylene film of varying thicknesses, typically 6 to 8 mils.

In a conventional stud wall structure, therefore, typically there will be positioned an exterior sheathing material (which also provides racking strength and may replace diagonal or sway bracing) The sheathing is attached to a stud wall structure comprising top and bottom plates and intermediate vertical studs, typically of 4–6 inch thickness. Countries having seasonally cold climates normally utilize insulation in the walls to prevent loss of heat during the cold seasons. Accordingly insulation such as glass fiber or rock wool material is inserted between the studs. A vapour barrier of polyethylene film is glued or stapled to the interior of the stud wall face, and an interior finishing material such as gypsum board, plaster board or other panelling material is applied directly over the vapour barrier.

In the type of construction described above, the mechanical structure as well as vapour and air barriers required by typical building codes is provided. However, this minimal structure is subject to degradation over time, and does not provide other attributes which may be desirable in residential construction.

In such typical construction, the polyethylene vapour barrier film is suspended between vertical studs, and has lateral support only on the interior surface, against the plaster board or other interior surface materials. Consequently, although the vapour barrier is supported against a positive air pressure into the structure, whereby the film will be pressed against the rigid surface of the plaster board, negative air pressure will tend to draw the vapour barrier away from the interior surface of the plaster board, causing flexing, stress, and, over time, ultimately may cause failure of the integral barrier through material failure of the film. The risk of material failure can be reduced by use of heavier or specialized polyethylene film, but cannot be entirely eliminated in the absence of a further lateral supporting surface for the film against negative pressures.

SUMMARY OF THE INVENTION

The present invention provides a composite insulating and vapour barrier building panel comprising a first semi-rigid structural insulation component and a second laminar barrier component integral with said first component, the second component being substantially impervious to atmospheric moisture and air penetration. This novel panel overcomes the deficiencies of a suspended film vapour barrier by providing a laminated air and vapour barrier supported on and bonded to a semi-rigid structural panel, thereby reducing or eliminating the risk of mechanical failure of the vapour barrier. Continuity of the vapour barrier is provided by compatible sealing material at all joints of the panels. In addition, the present invention provides augmented insulating value to the structure, additional sound absorption properties and inhibits loss of radiated heat from the structure. In a preferred embodiment, the invention comprises a panel of low density fibreboard having integral layer of metal foil on one surface. Adjacent panels are abutted in a finished wall structure with a sealer tape applied over the abutting joint to provide vapour impermeability and integrity. In still a further embodiment, a laminate of metal foil on kraft paper is applied to the fibreboard in place of the previously disclosed foil layer, with the kraft surface of the laminate adjacent to the fibreboard.

BRIEF DESCRIPTION OF THE VIEWS OF DRAWINGS

The present invention will now be described in conjunction with the accompanying drawing which illustrate a preferred embodiment of the invention.

Figure 2:
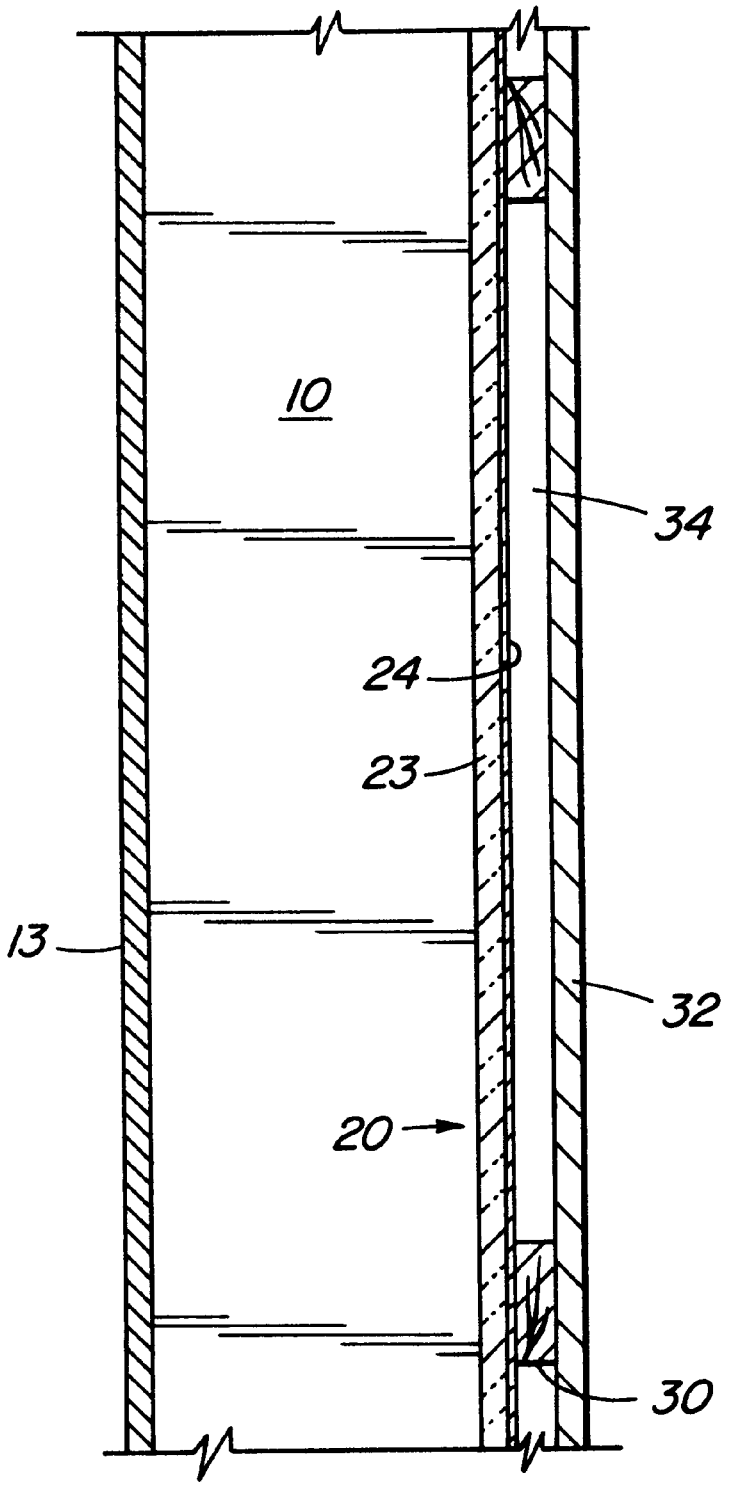

FIG. 1 is a perspective view, partially in section, of a stud wall construction in accordance with the present invention; and FIG. 2 in a cross-section of a portion of the stud wall construction of FIG. 1 at line A—A.

DETAILED DESCRIPTION OF PREFERRED EMBODIMENT

A residential stud wall construction utilizing the building panel of the present invention is illustrated in FIG. 1. The structure comprises a framework (1) having an interior face (2) and an exterior face (3). Studs (10) extend between a bottom or sole plate (11)and a double top plate (12). Typically, the vertical studs may be 2'×4' or 2'×6' wooden studs or may be manufactured metal studs of a preformed 'U' configuration. The studs (10) are typically spaced at 16 inch or 24 inch intervals such that 4 foot wide panels may be abutted and joined at stud centers.

An exterior sheathing (13) applied to the exterior face of the stud wall is selected from plywood, particle board, ASPENITE™ or fibreboard having varying degrees of insulation value, rigidity and weight depending upon the choice of the builder.

Bats of insulation (14) are inserted snugly to fill the air space defined between the studs (10), the sole plate (11), top plate (12) and sheathing (13). In prior art construction, a polyethylene film would typically be stapled to the interior face of the studs (10) and plates (11 and 12)to comprise a vapour barrier.

In the construction method of the present invention, semi-rigid panels (20) are applied to the interior face (2) of the framework (1). The panels, described in greater detail hereafter, have a continuous, substantially vapour impermeable metal foil barrier on one face. The metal foil surface is positioned towards the interior of the building structure. Depending upon the size of panels selected, the panels may be installed with a horizontal or vertical orientation. In FIG. 1, panels (20) are installed vertically and would typically be of 4'×8' construction. Panels (20) are installed with glue, nails, screws or other suitable fastening means so that their side edges (21) abut at the center line of a stud (10). A compatible self-adhesive foil tape (22) is then applied over the faces of the panels at the abutting edges (21) to provide a continuous vapour seal over the joint.

To complete the wall structure, in the preferred form of construction, a series of horizontal parallel straps or furring strips (30) are attached to the stud framework, typically by nailing or screwing through the panels (20) into the studs and plates. The strapping is typically positioned at approximately two foot vertical intervals to correspond with the dimensions of the interior finishing material. Then, interior dry-wall or gypsum board (32) is attached to the strapping by nails or screws (33). At the choice of the builder, such dry wall panelling (32) may be installed horizontally or vertically. Any joints in the dry wall panelling are completed with tape and appropriate dry wall compound in the known manner of construction.

When dry wall (32) is installed over strapping (30), an air space (34) is generated between the rows of strapping, which provide an additional dead air gap with resultant decrease in heat loss through conduction or convection. Optionally a thin layer of insulating material, typically glass fiber, could be installed between the rows of strapping.

As an alternative construction, strapping (30) may be eliminated and the dry wall (32) attached directly against the insulating panels (20), by screws or other fasteners extending into the studs (10).

Building panels (20) are preferably made from low or medium density fibreboard having a thickness of approximately ½–¾ inch and a panel size compatible with 4 foot modules used in the North American construction industry. Such fibreboards may be wet or dry formed of wood or paper fibers, in varying densities, and using various natural or added adhesives for bonding of the fibers for structural integrity. Typically, a panel may be 4'×8', 4'×12' or 4'×16'. The panels (20) comprise a first insulating layer (23) of compacted and adhered woodfibers which provides a semi-rigid light-weight structure. A ¾ inch fibreboard will provide an insulation factor of about R2.06. Fibreboard such as CELLOTEX™, TENTEST™ or beaver board may be used. On one surface, hereinafter designated as the "interior surface", a metallic foil (24)is adhered. A satisfactory foil has been found to be aluminum foil of 2–3 mils thickness. An adhesive is used to bond the foil to the fibreboard surface, after the board has been formed. Alternatively, the adhesive or bonding agent employed in the manufacture of the fibreboard may also be used to adhere the foil onto the board surface when the foil is applied concurrently with the formation of the board.

As an alternative construction, the metal foil layer may be substituted by a composite layer of kraft paper with a foil coating. Such a composite with a kraft paper of about 3 mils and a foil layer of about 0.25 mils has been found to be satisfactory. The composite may be adhered to the fiberboard with a low density polythene glue.

Optionally, during manufacture of the panels, appropriate visual markings may be placed on the foil surface (23) to indicate typical stud spacing, thereby aiding in the positioning and attachment of the panels during the assembly process, and aiding in the subsequent attachment of strapping (30) and drywall (32). A variant of the foregoing panels can substitute metallized plastic film such as manufactured by Mobile Corporation under the trade-mark METALYTE in place of the metal foil.

From the foregoing, it will be seen that semi-rigid panels (20), as a result of their light fibreboard composition, provide augmented insulation to the wall structure, as well as additional sound deadening capabilities. A corollary benefit of the aluminum foil (23) is the reflection and retention of radiant heat within the building structure. Furthermore, the foil surface (23) substantially provides both an air and vapour impermeable membrane, which ensures compliance with most building codes. The continuity of this membrane is insured by sealer tape (22) applied at the abutting edges (21) of panels (20).

Although the above-described embodiment is preferred form of the invention, the invention is not to be limited to the specific details of construction described herein and for definitions of the invention, reference is to be made to the appended claims.

What is claimed is:

1. A composite insulating and vapour barrier building panel adapted for use in stud wall building construction, consisting of a first semi-rigid flat structural insulation component, selected from the group comprising a low density and a medium density fiberboard, and a second laminar barrier component integral with said first component, the second component being substantially flat and substantially impervious to atmospheric vapour and air penetration, wherein the second component is selected from the group comprising metallic foil, metalized thermoplastic film and a composite of layered thermoplastic film and metallic foil.

2. The panel of claim 1 wherein the metallic foil is an aluminum foil, and the metalized thermoplastic film is an aluminized film.

3. The panel of claim 2 wherein the aluminum foil includes visual marking at predetermined intervals on the surface.

4. The panel of claim 1 wherein the second component includes a layer of kraft paper adhered to the fiberboard.

5. The panel of claim 1 wherein the second component comprises individual layers of kraft paper, polyethylene and aluminum foil.

6. The panel of claim 1 wherein the thermoplastic film is a polyethylene film or a polypropylene film.

7. A stud wall building construction having a plurality of insulating, vapour barrier panels, with adjoining panels joined by a vapour impervious seal, the panels comprising a first semi-rigid structural insulation component selected from the group comprising a low density and a medium density fiberboard, and a second substantially flat laminar vapour barrier component integral with said first component, the second component being selected from the group comprising metallic foil, metalized thermoplastic film, or a composite of layered thermoplastic film and metallic foil.

8. The construction of claim 7 wherein the foil is an aluminum foil, and the metalized thermoplastic film is an aluminized film.

9. The construction of claim 7 wherein the second component includes a layer of kraft paper adhered to the fiberboard.

10. The construction of claim 7 wherein the seal is a suitable plastic or foil tape.

11. The construction of claim 7 wherein the thermoplastic film is a polyethylene film or a polypropylene film.

12. A composite insulating and vapour barrier building panel consisting of a low density fiberboard panel with a continuous flat effective air and vapour barrier integral with one face of the fiberboard panel, the barrier comprising a continuous layer of kraft paper adjacent the fiberboard panel and a continuous layer of aluminum foil adjacent the layer of kraft paper.

13. A composite insulating and vapour barrier building panel consisting of a low density fiberboard panel with a continuous flat effective air and vapour barrier integral with one face of the fiberboard panel, the barrier comprising a continuous layer of polyethylene film adjacent the fiberboard panel and a continuous layer of aluminum foil adjacent the layer of polyethylene film.

14. A composite insulating and vapour barrier building panel consisting of a low density fiberboard panel with a continuous flat effective air and vapour barrier integral with one face of the fiberboard panel, the barrier comprising a continuous layer of kraft paper adjacent the fiberboard panel, a continuous layer of polyethylene film adjacent the layer of kraft paper and a continuous layer of aluminum foil adjacent the layer of polyethylene film.

15. A composite insulating and vapour barrier building panel consisting of a low density fiberboard panel with a continuous flat aluminum foil layer integral with one face of the fiberboard panel to provide an effective air and vapour barrier.

* * * * *